US009010562B1

(12) United States Patent
Sparks

(10) Patent No.: US 9,010,562 B1
(45) Date of Patent: Apr. 21, 2015

(54) MAGNETIC TRASH CAN ANCHOR

(71) Applicant: Stewart C. Sparks, Jeffersonville, KY (US)

(72) Inventor: Stewart C. Sparks, Jeffersonville, KY (US)

( * ) Notice: Subject to any disclaimer, the term of this patent is extended or adjusted under 35 U.S.C. 154(b) by 0 days.

(21) Appl. No.: 14/183,575

(22) Filed: Feb. 19, 2014

Related U.S. Application Data

(63) Continuation-in-part of application No. 13/415,176, filed on Mar. 8, 2012, now abandoned.

(51) Int. Cl.
*B65D 25/22* (2006.01)
*B65F 1/14* (2006.01)

(52) U.S. Cl.
CPC ..... *B65F 1/141* (2013.01); *B65F 1/1473* (2013.01); *B65F 1/1468* (2013.01)

(58) Field of Classification Search
CPC ..... B65F 1/141; B65F 1/1468; B65F 1/1473
USPC ..... 280/9, 43.12, 79.2, 79.5; 220/475, 812, 220/483, 480, 636, 630; 206/386
See application file for complete search history.

(56) References Cited

U.S. PATENT DOCUMENTS

| | | | | | |
|---|---|---|---|---|---|
| 836,555 | A | | 11/1906 | Birnie | |
| 2,580,319 | A | * | 12/1951 | Poupitch | 411/349 |
| 2,971,739 | A | | 2/1961 | Kirkland | |
| 3,243,194 | A | * | 3/1966 | Trusock | 280/43.12 |
| 3,249,170 | A | * | 5/1966 | Quayle | 180/19.2 |
| 4,072,286 | A | | 2/1978 | Foncannon | |
| 4,872,582 | A | | 10/1989 | Sipple | |
| 5,143,389 | A | * | 9/1992 | Jonkers | 280/47.26 |
| 6,042,080 | A | * | 3/2000 | Shepherd et al. | 248/683 |
| 6,042,127 | A | * | 3/2000 | Rupolo | 280/33.998 |
| D436,705 | S | * | 1/2001 | Dow et al. | D34/5 |
| 6,682,084 | B2 | * | 1/2004 | Webster et al. | 280/79.5 |
| 6,786,349 | B2 | | 9/2004 | Najd | |
| 6,880,837 | B2 | * | 4/2005 | Nandram et al. | 280/79.11 |
| 7,494,098 | B1 | * | 2/2009 | Fulda | 248/206.5 |
| 7,963,534 | B2 | * | 6/2011 | Sloat | 280/79.5 |
| 2006/0125196 | A1 | * | 6/2006 | Hartmann et al. | 280/43.12 |
| 2008/0056810 | A1 | * | 3/2008 | Granata | 403/121 |

* cited by examiner

*Primary Examiner* — Fenn Mathew
*Assistant Examiner* — Don M Anderson
(74) *Attorney, Agent, or Firm* — Robert C. Montgomery; Montgomery Patent & Design, LP

(57) ABSTRACT

A magnetic trash can anchoring system includes a plate anchored to a trash can and a magnetic plate which is attached to a desired ground surface. The system secures the trash can in an upright position to prevent overturning and accidental toppling. Alternately, the system can also be part of the original equipment of the trash can. In a second alternative, the anchor plate is further provided with a wheeled assembly to assist with disengagement of the anchor plate and magnetic plate and to assist with transportation of the attached trash can.

12 Claims, 12 Drawing Sheets

MAGNETIC TRASH CAN ANCHOR

RELATED APPLICATIONS

This is a Continuation-In-Part of U.S. patent application Ser. No. 13/415,176, filed Mar. 8, 2012, which is incorporated herein by reference in its entirety.

FIELD OF THE INVENTION

The present invention relates generally to a trash can, and in particular, to anchors for trash cans.

BACKGROUND OF THE INVENTION

The task of taking out the trash is one that most people do not enjoy. One must endure smelly trash, leaking bags, flies, and other undesirable circumstances while taking the day's trash out to the trash can. One (1) facet of this task that is particularly annoying is the fact that many cans, especially when empty, tend to blow all over the yard, get run over and damaged by passing traffic, or just generally become lost. Those of us who are unable to retrieve their cans on trash collection day from the curb when they are emptied, usually arrive home to find the cans nowhere in sight and must search the neighborhood for them. Other problems arise when dogs or other animals knock over trash cans to get at food scraps that are disposed of. Accordingly, there exists a need for a means by which trash cans can be prevented from being knocked over by wind or animals in a manner that addresses the problems described above.

Various attempts have been made to provide an anchor for trash can. Examples of these attempts can be seen by reference to several U.S. patents. U.S. Pat. No. 2,971,739, issued in the name of Kirkland, describes a trash can hold and lid securing means.

U.S. Pat. No. 4,872,582, issued in the name of Sipple, describes a weighted trash can container.

U.S. Pat. No. 6,786,349, issued in the name of Najd, describes a trash can having tip resistant features.

While these devices fulfill their respective, particular objectives, each of these references suffer from one (1) or more disadvantages. Many such devices are not suited to securely anchor a trash can into a ground surface. Another problem area is the lack of ease to utilize. Furthermore such devices can not be utilized on all types of trash cans. Accordingly, there exists a need for trash can with anchor without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for an anchoring means for a trash can.

Accordingly, it is an object of the present embodiments of the invention to solve at least one of these problems. The inventor has addressed this need by developing a magnetic anchor for a trash can.

To achieve the above objectives, it is an object of the present invention to provide a magnetic trash can anchor.

Another object of the present invention is to provide the magnetic trash can anchor with a trash can plate, a stake, and a ground plate.

Yet still another object of the present invention is to comprise the trash can plate with a ferrous metal.

Yet still another object of the present invention is to provide a trash can plate upper surface with a plurality of fastening means.

Yet still another object of the present invention is to provide the stake with opposing anchors for securing into the ground plate.

Yet still another object of the present invention is to provide the ground plate with a housing and a magnet.

Yet still another object of the present invention is to provide the ground plate housing with an aperture and slots to receive the stake.

Yet still another object of the present invention is to provide an alternate trash can and an integral alternate plate.

Yet still another object of the present invention is to provide an alternative plate with wheel assemblies and a slide bar to assist with disengaging the alternative plate and trash can from the ground plate and transport the trash can about the wheels.

Yet still another object of the present invention is to provide a method of utilizing the device that provides a unique means of fastening the trash can plate to a trash can with a fastening means, securing the ground plate into a ground surface with the stake, engaging the trash can plate to the magnet on the ground plate to secure the trash can to the anchor, and sliding the trash can plate off of the ground plate to remove the trash can from a secured position.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
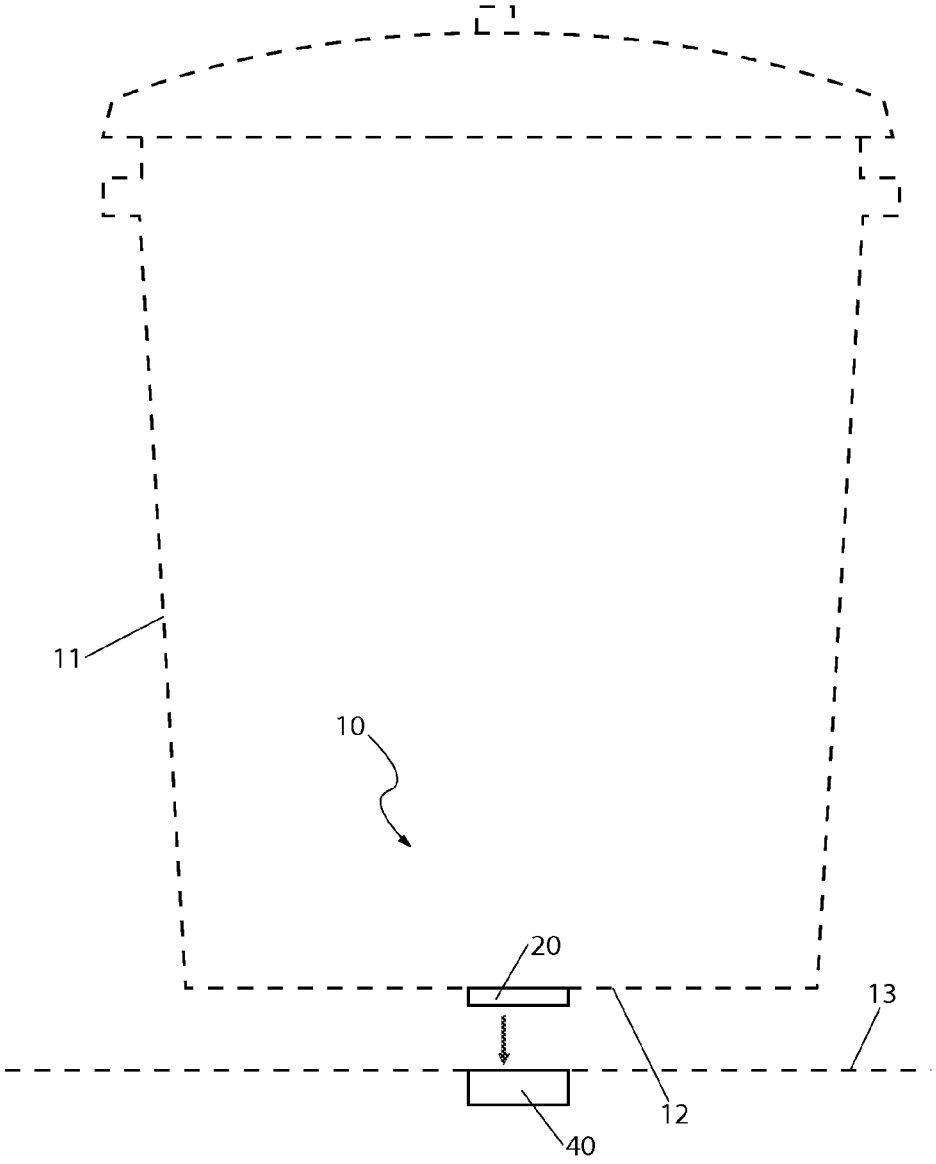
FIG. 1 is an environmental view of a magnetic trash can anchor 10, according to a preferred embodiment of the present invention.

10 magnetic trash can anchor
11 trash can
12 trash can bottom surface
13 ground surface
14 person
20 trash can plate
21 trash can plate upper surface
22 first fastening means
23 trash can plate bottom surface
30 stake
31 anchor
40 ground plate
41 housing
42 aperture
43 slot
44 magnet
45 magnet aperture
50 alternate embodiment
51 alternate trash can
52 alternate plate
60 alternative embodiment
61 alternative plate
62 alternative upper surface
63 alternative lower surface
64 second fastening means
65 first slide channel
66 second slide channel
67 longitudinal direction
68 first side
69 second side
70 slide top surface
71 lateral side surface
72 slide bottom surface
73 slide slot
74 wheel assembly
75 wheel
76 axle
77 upward and downward motion
78 wheel bottom
79 slide bar
80 flange
81 fork
82 wheel top
83 beveled tip
84 wheel opening
85 detent
86 outer side
87 latch
88 beveled edge
89 flat edge
90 front end
91 back end

DETAILED DESCRIPTION OF THE PREFERRED EMBODIMENT

Figure 4:
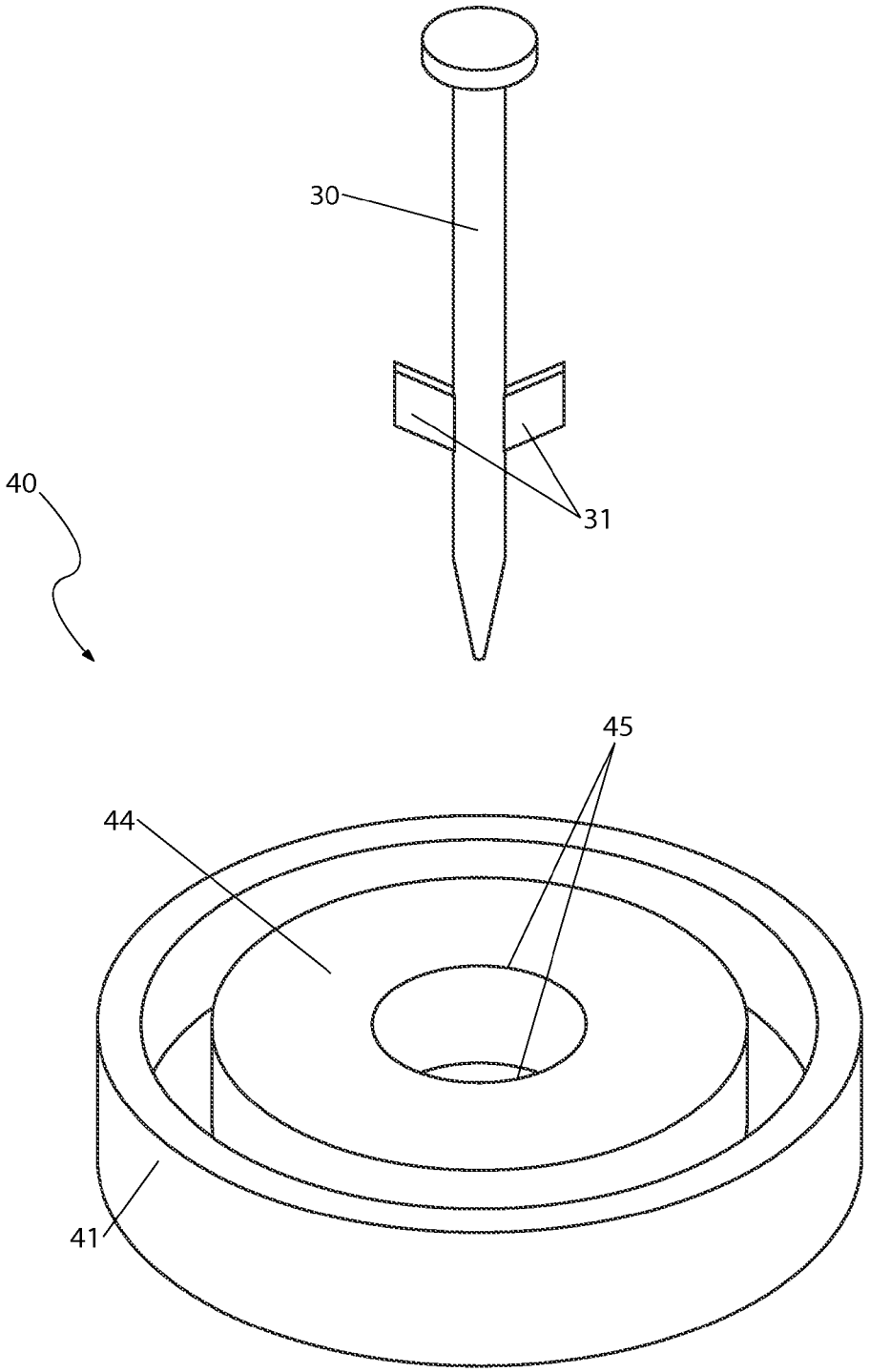
FIG. 4 is a perspective view of a spike 30 and a ground plate 40, according to a preferred embodiment of the present invention.
Figure 5:
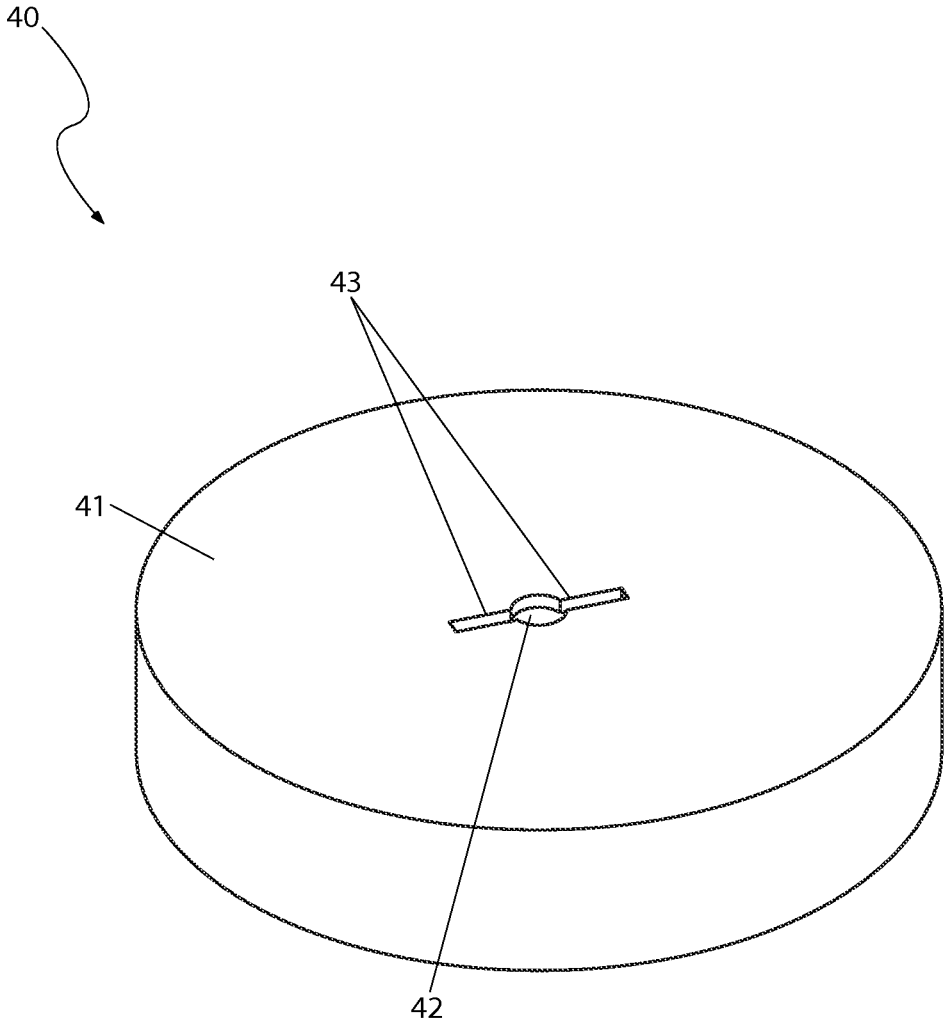
FIG. 5 is an underside perspective view of the ground plate 40, according to a preferred embodiment of the present invention; and, FIG. 6 is a perspective view of an alternate embodiment 50, of the present invention.
Figure 6:
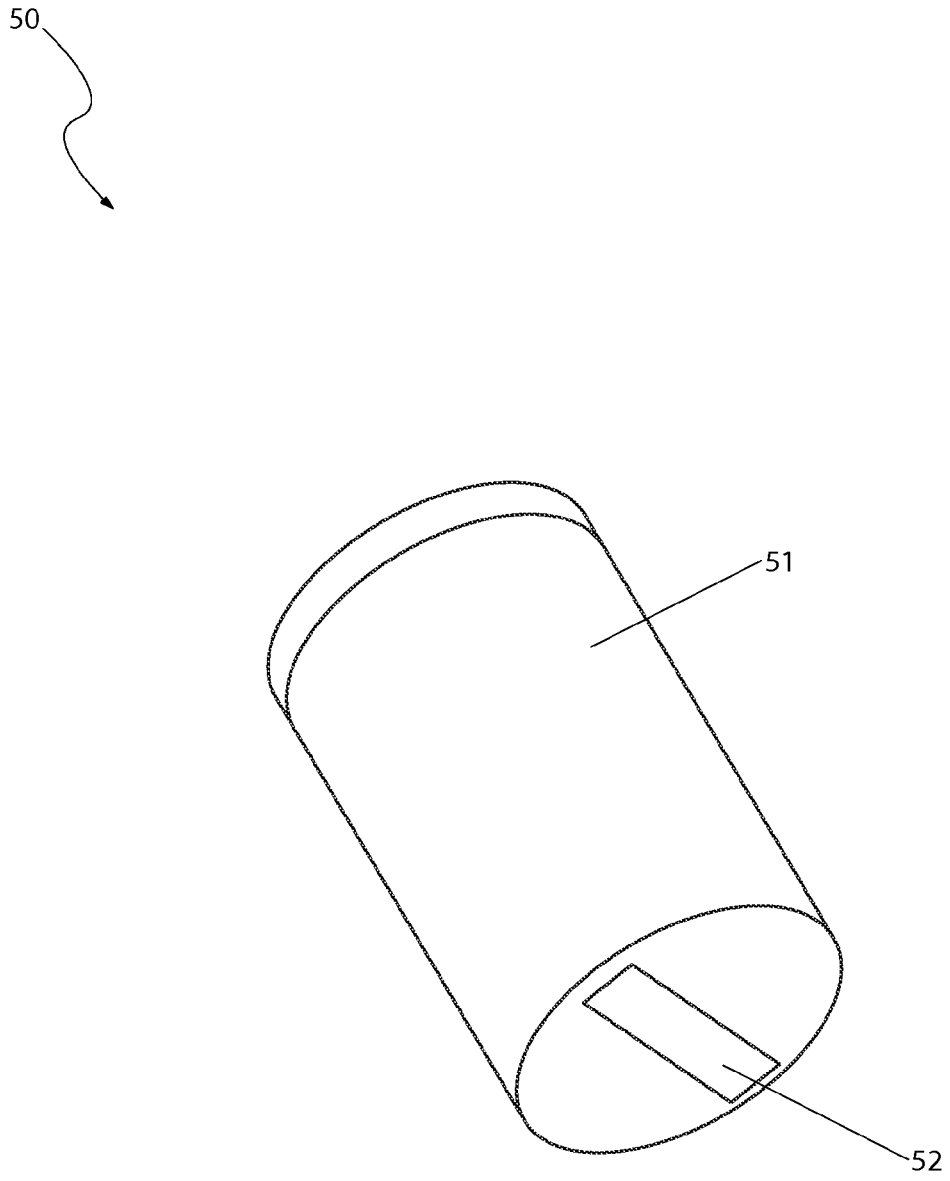

The best mode for carrying out the invention is presented in terms of its preferred embodiment, herein depicted within FIGS. 1 through 5, within an alternate embodiment 50 of FIG. 6, and within an alternative embodiment of FIGS. 7 through 12. A person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a magnetic trash can anchor (herein described as the "system") 10, which provides a means to secure a trash can 11 to a desired surface which eliminates misplacement and toppling.

Referring now to FIG. 1, an environmental view of the system 10, according to the preferred embodiment of the present invention, is disclosed. The system 10 comprises a trash can plate 20, a stake 30, and a ground plate 40. The trash can plate 20 is attached to a bottom surface 12 of a desired trash can 11. The ground plate 40 is attached to a ground surface 13 and secured with the stake 30. The trash can plate 20 and ground plate 40 are magnetically attachable from each other to secure the trash can 11.

Figure 2:
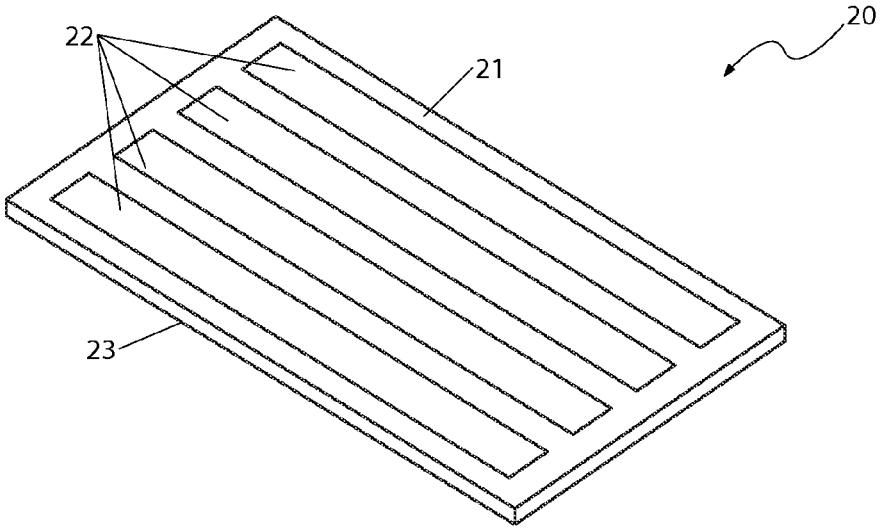
FIG. 2 is a perspective view of a trash can plate 20, according to a preferred embodiment of the present invention.
Figure 3:
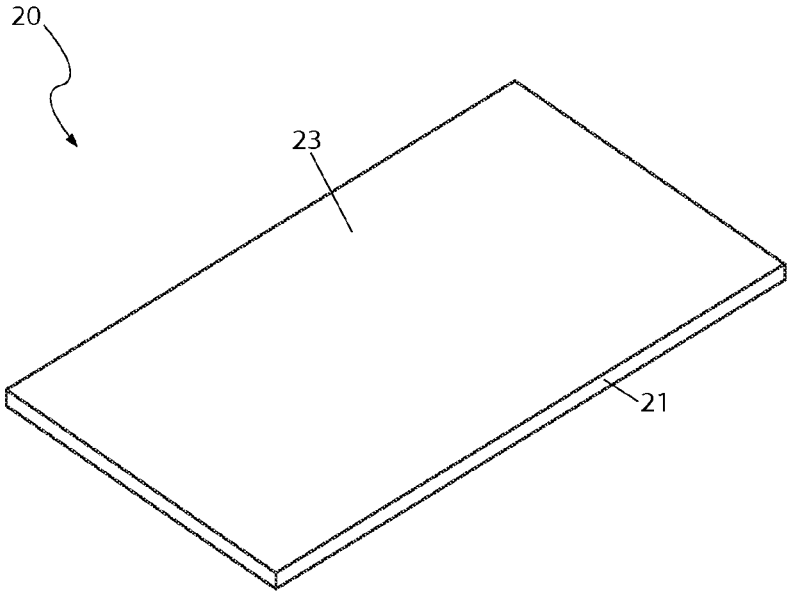
FIG. 3 is an opposing perspective view of the trash can plate 20, according to a preferred embodiment of the present invention.

Referring now to FIG. 2, a perspective view of the trash can plate 20 and FIG. 3, an opposing perspective view of the trash can plate 20, according to the preferred embodiment of the present invention, are disclosed. The trash can plate 20 is comprised of a plate comprised of a ferrous metal. The trash can plate 20 can be fabricated in various shapes which correspond to the shape of the trash can bottom surface 12. A trash can plate upper surface 21 includes a plurality of first fastening means 22 which are depicted as adhesive strips which adhere to the trash can bottom surface 12. Adhesive strips provide a non-damaging device for attachment. The first fastening means 22 can also include other mechanical devices such as nuts and bolts or the like. A trash can plate bottom surface 23 engages the ground plate 40.

Referring now to FIG. 4, a perspective view of the stake 30 and the ground plate 40 and FIG. 5, an underside perspective view of the ground plate 40, according to the preferred embodiment of the present invention, is disclosed. The stake 30 is inserted through the ground plate 40 and into the ground surface 13 to secure the ground plate 40. The stake 30 is comprised of a cylindrical shape with a tapering end point. The stake 30 also includes a pair of opposing anchors 31 which secure the stake 30 into the ground surface 13 and prevents accidental removal.

The ground plate 40 includes a housing 41 and a magnet 44. The ground plate 40 is preferably flush with the ground surface 13 with the magnet 44 orientated upwardly toward the trash can bottom surface 12 (see FIG. 4). The housing 41 and a magnet 44 are depicted as having a cylindrical shape for illustration purposes only it is known that other shapes can be utilized without limiting the scope of the system 10. The magnet 44 is adhered within the housing 41. The housing 41 is a nonferrous material and provides shielding and protection to the magnet 44. The housing 41 comprises an open top which reveals the magnet 44 to enable a magnetic attraction between the magnet and the trash can plate bottom surface 23. A bottom surface of the housing 41 includes an aperture 42 which further includes a pair of opposing slots 43. The aperture 42 and slots 43 enable the stake 30 and anchors 31, respectively, to be routed through to further engage the ground surface 13. The aperture 42 is to be slightly larger than the stake 30 and the slots 43 are to be slightly larger than the anchors 31. The magnet 44 is to also comprise a magnet aperture 45 which enables the magnet 44 not to interfere with the insertion of the stake 30 into the aperture 42 and slot 43.

Referring now to FIG. 6, a perspective view of an alternate embodiment 50, of the present invention, is disclosed. The alternate embodiment 50 includes an alternate trash can 51 and an alternate plate 52. The alternate trash can 51 is depicted as a cylindrical refuse container for illustration purposes only; it is known that other shapes may be utilized without limiting the scope of the invention. The alternate trash can 51 is fabricated from durable materials such as plastic. The alternate trash can 51 can also comprise various sizes and capacities. The alternate plate 52 is similar to the abovementioned trash can plate 20, yet is integrally molded into a bottom portion of the alternate trash can 51. It is known that the alternate embodiment 50 would also utilize a stake 30 and a ground plate 40 as abovementioned.

Figure 7:
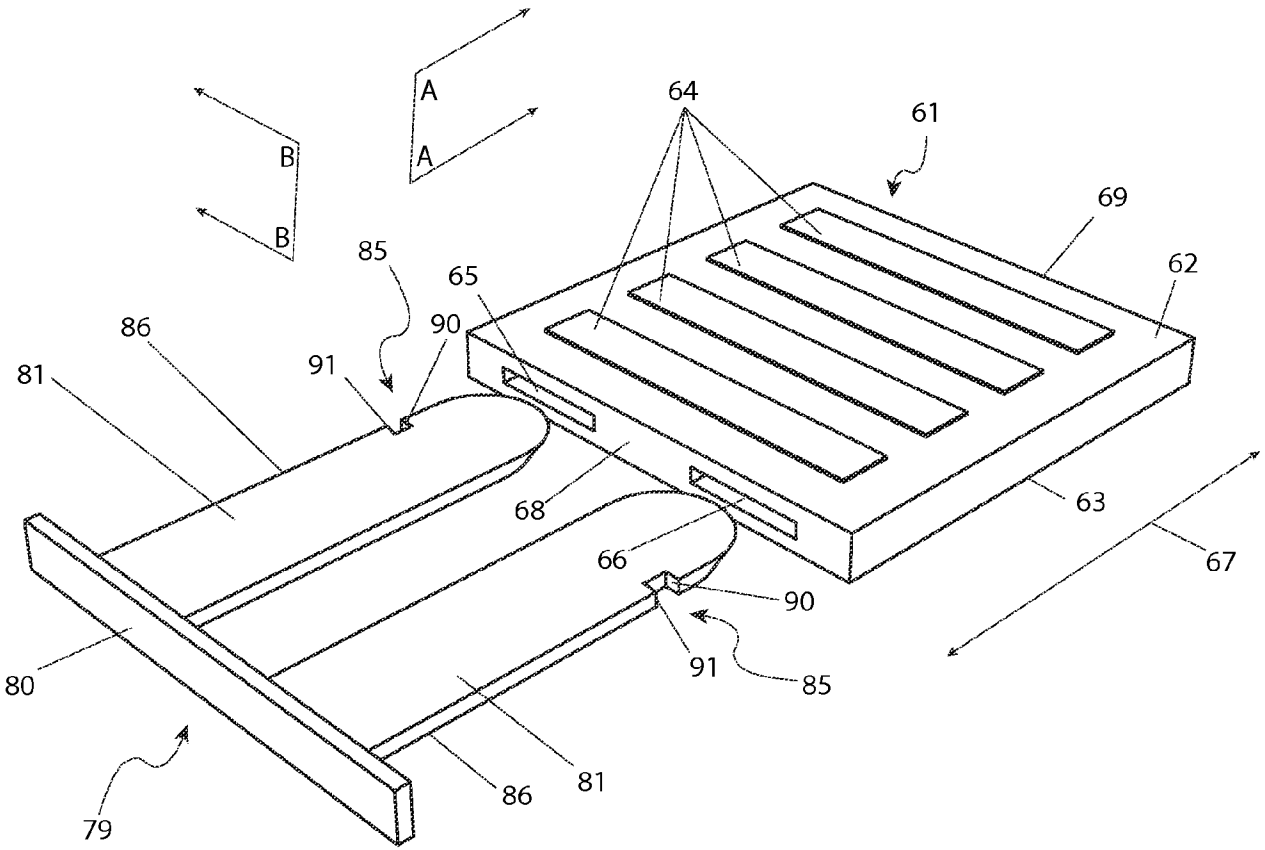
FIG. 7, a top perspective view of an alternative embodiment 60, of the present invention.
Figure 8:
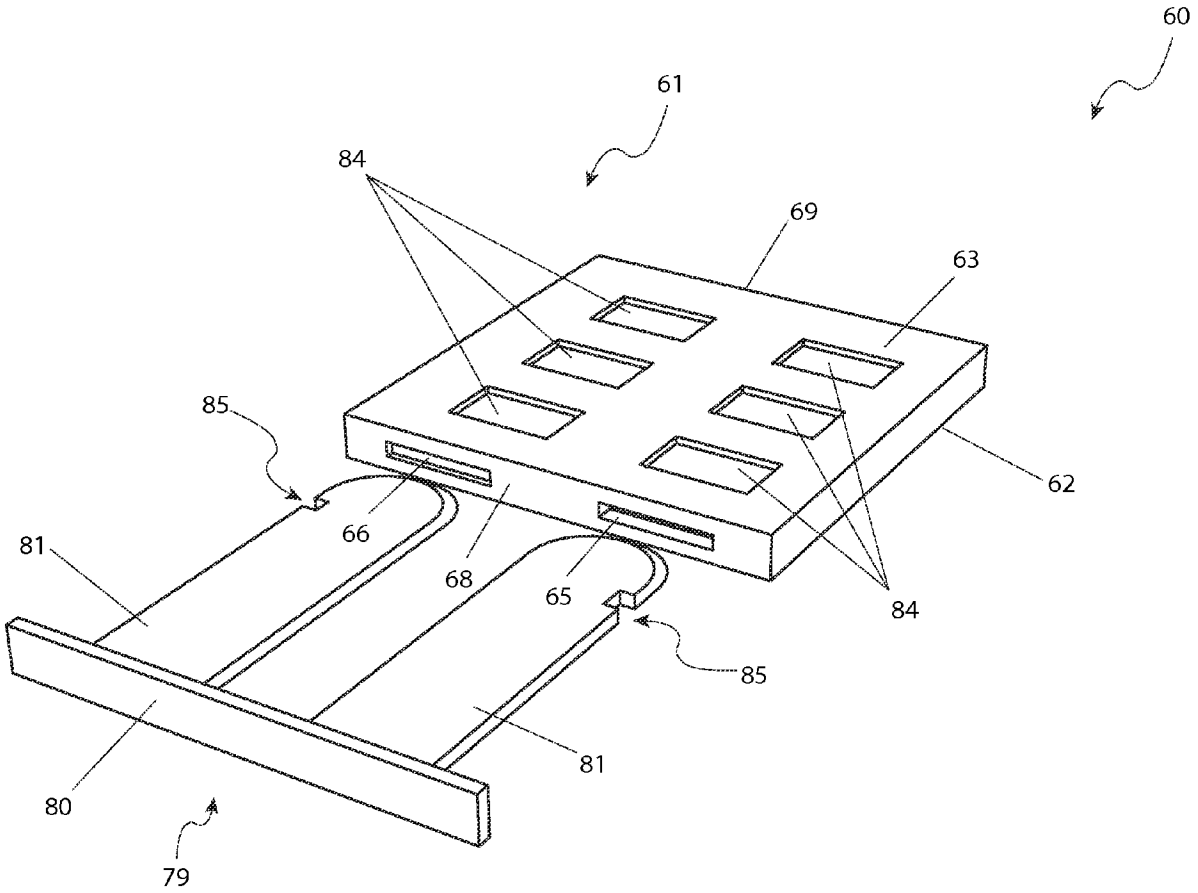
FIG. 8 a bottom perspective view of the alternative embodiment 60 with the wheel assemblies 74 removed for illustration into each wheel opening 84, of the present invention.

Referring now to FIGS. 7 and 8, perspective views of an alternative embodiment 60 of the present invention are disclosed. The alternative embodiment 60 includes an alternative plate 61. The alternative plate 61 has an alternative upper surface 62, which is similar to the trash can plate upper surface 21 of the preferred embodiment. The alternative upper surface 62 is provided with second fastening means 64 that are similar to the first fastening means 22 disposed on the trash can upper surface 21 of the preferred embodiment. The alternative plate 61 has an alternative lower surface 63 that is similar to the trash can plate bottom surface 23 of the preferred embodiment, but it is provided with at least two (2) wheel openings 84 as shown in FIG. 8. Within a central portion of the alternative plate 61 are at least two (2) slide channels 65, 66 comprising a first slide channel 65 and a second slide channel 66. Each slide channel 65, 66 is arranged in a parallel manner with respect to each other and situated along a longitudinal direction 67 of the alternative plate 61. Each slide channel 65, 66 is identical to the other, preferably rectangular in shape, and extends from a first side 68 of the alternative plate 61 to a second side 69.

Figure 9:
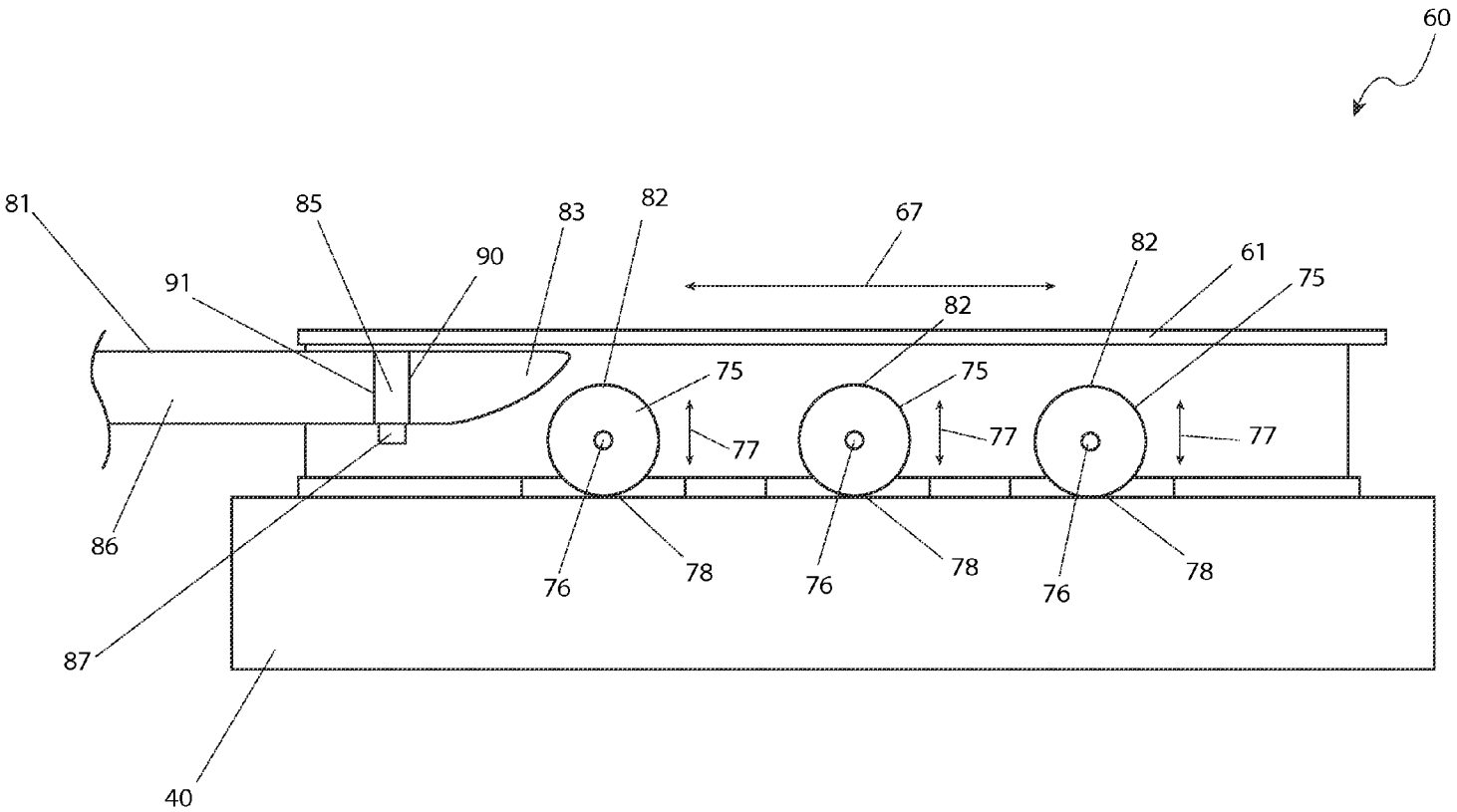
FIG. 9 is a partial cross sectional side view along the A-A line (see FIG. 7) of the alternative embodiment 60 showing an internal view of a first slide channel 65, of the present invention.
Figure 10:
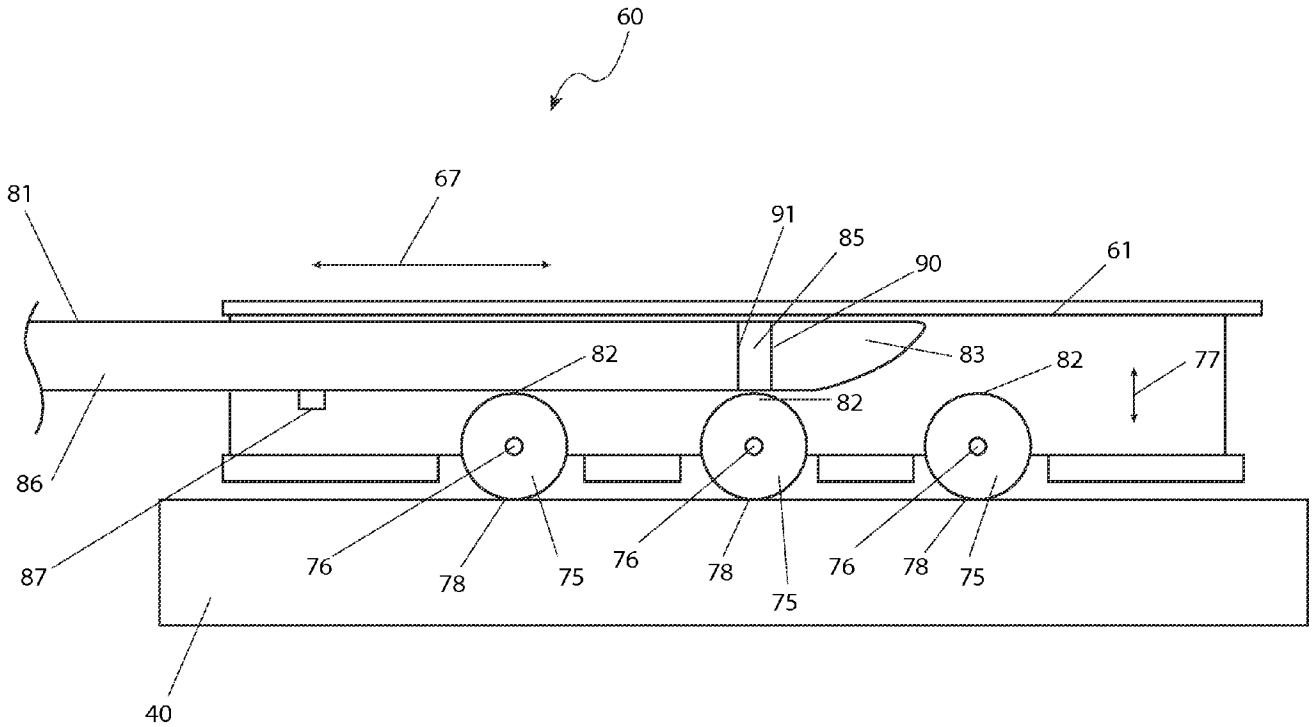
FIG. 10 is another partial cross sectional side view along the A-A line (see FIG. 7) of the alternative embodiment 60 showing an internal view of a first slide channel 65, of the present invention.
Figure 11:
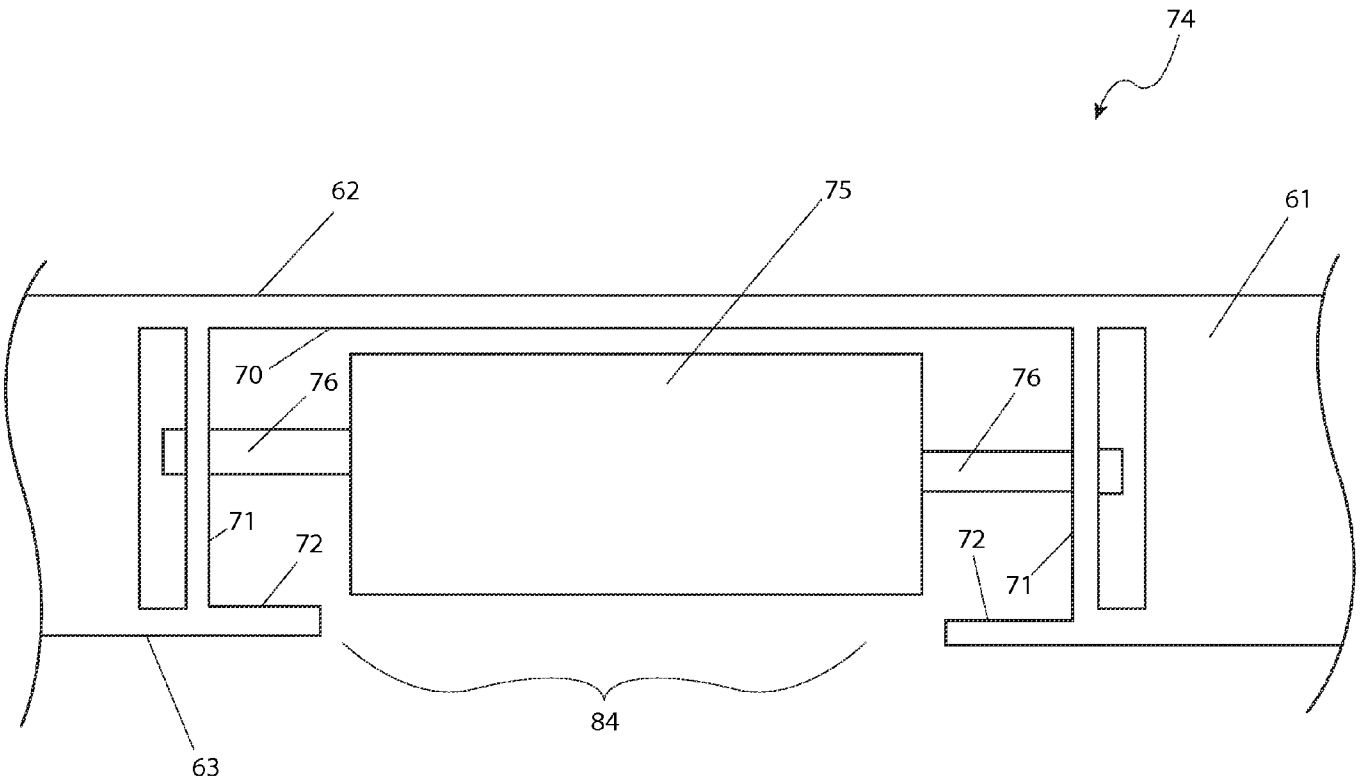
FIG. 11 is a partial cross sectional side view along the B-B line (see FIG. 7) showing the wheel assembly 74 of the alternative embodiment 60, of the present invention.

Referring now to FIGS. 9, 10, and 11, partial cross sectional side views along the A-A line and B-B line (see FIG. 7) of the alternative embodiment 60, are disclosed. FIGS. 9, 10, and 11 only illustrate the first slide channel 65, however, it is understood that the second slide channel 66 is identical to the first slide channel 65. Each slide channel 65, 66 comprise a slide top surface 70, two (2) opposing lateral side surfaces 71, and a slide bottom surface 72. Again, FIGS. 9 and 10 illustrate a single lateral side surface 71; however, it is understood that each lateral side surface 71 is identical. Each slide channel 65, 66 is provided with at least one (1) pair of slide slots 73 disposed on the lateral side surfaces 71 and diametrically opposing each other. Rotatingly affixed to each pair of slide slots 73 is a wheel assembly 74 comprising a wheel 75 rotatingly affixed to an axle 76, where distal ends of each axle 76 slidably engage opposing side slots 73. It is envisioned for each wheel 75 to be rotatingly affixed to the axle 76 via a hub and ball-bearing construction commonly used in the art and disclosed in U.S. Pat. No. 2,572,835; however, other methods of rotatingly affixing the wheel 75 to the axle 76 may be utilized without deviating from the teachings of the system 10. A wheel opening 84 is disposed in a slide bottom surface 72 directly below each wheel assembly 74, and is configured to enable each wheel 75 to protrude through the alternative lower surface 63. Each slide slot 73 is configured to enable upward and downward motion 77 of the wheel assembly 74 so that each axle 76 may traverse a length of the side slots 73. The length of each side slot 73 is such that when each wheel assembly 74 is motioned in a fully upward direction each wheel bottom 78 is flush with, or recessed within, the alternative lower surface 63, as shown in FIG. 9. When each wheel assembly 74 is motioned in a fully downward direction, each wheel bottom 78 enables an elevated supported position of the alternative plate 61, where each wheel 75 creates a space between the alternative lower surface 63 and the ground surface 13, as shown in FIG. 10. It is envisioned for each wheel 75 to comprise a very weakly magnetic material or nonferrous material such as aluminum, plastic, or rubber.

The alternative embodiment 60 is further provided with a slide bar 79. The slide bar 79 comprises a flange 80 with a fork 81 for each slide channel 65, 66, perpendicularly affixed to the flange 80, where each fork 81 is arranged in a parallel manner to each other. Each fork 81 has a shape complementing the shape of each slide channel 65, 66, yet exhibiting a slightly smaller cross-sectional area than that of each side channel 65, 66 so as to enable insertion of a fork 81 into a slide channel 65, 66. The slide bar 79 is configured to slidably engage the slide channels 65, 66 and enable motion of the slide bar 79 in the longitudinal direction 67 so that each fork 81 may traverse an entire length of each slide channel 65, 66 with which they are engaged. As the slide bar 79 is slid into the alternative plate 61 from the first side 68 to the second side 69, each fork 81 engages a wheel top 82 and forces each wheel assembly 74 into a fully downward direction. As the slide bar 79 is slid from the second side 69 to the first side 68, each fork 81 disengages each wheel top 82, allowing each wheel assembly 74 to freely traverse the side slot 73 in which it is rotatingly engaged. Each fork 81 preferably is configured to have a beveled tip 83 to facilitate smooth engagement and disengagement with each wheel top 82. It is envisioned for the slide bar 79 to comprise a very weakly magnetic material or nonferrous material such as aluminum or plastic.

The alternative plate 61 may also be employed with the alternate embodiment 50 depicted in FIG. 5 without deviating from the teachings of the system 10. In this embodiment, the alternate plate 52 is replaced with the alternative plate 61 and slide bar 79. The alternative plate 61 is affixed, or integrally molded, to a trash can 51 as described in the alternate embodiment 50.

In use, the alternative plate 61 is fastened to the bottom of the trash can 11, 51 with the second fastening means 64, or be integrally molded, similar to how the trash can plate 20, 52 is fastened/molded. The ground plate 40 is positioned into the ground 13 as described in the preferred embodiment. The slide bar 79 is positioned to force each wheel assembly 79 into a fully downward direction, thus allowing the trash can 11, 51 and alternative plate 61 to be transported about on the wheel assemblies 74. Once positioned over the ground plate 40, the slide bar 79 is slid from the second side 69 to the first side 68 so that each fork 81 disengages each wheel top 82, allowing each wheel assembly 74 to freely traverse the side slot 73 in which it is rotatingly engaged. The weight of the trash can 11, 51 and alternative plate 61, along with the magnetic force pulling the alternative plate 61 and ground plate 40 together, forces the two (2) plates 61, 40 to abut each other, whereby each wheel assembly 74 is forced into a fully upward direction. When it is desired to disengage the trash can 11, 51 and alternative plate 61 from the ground plate 40, the slide bar 79 is slid from the first side 68 to the second side 69 so that each fork 81 engages a wheel top 82 and forces each wheel assembly 74 into a fully downward direction, whereby providing a lifting force to disengage the plates 61, 40 and support the trash can 11, 51 and alternative plate 61 in an elevated position.

Figure 12:
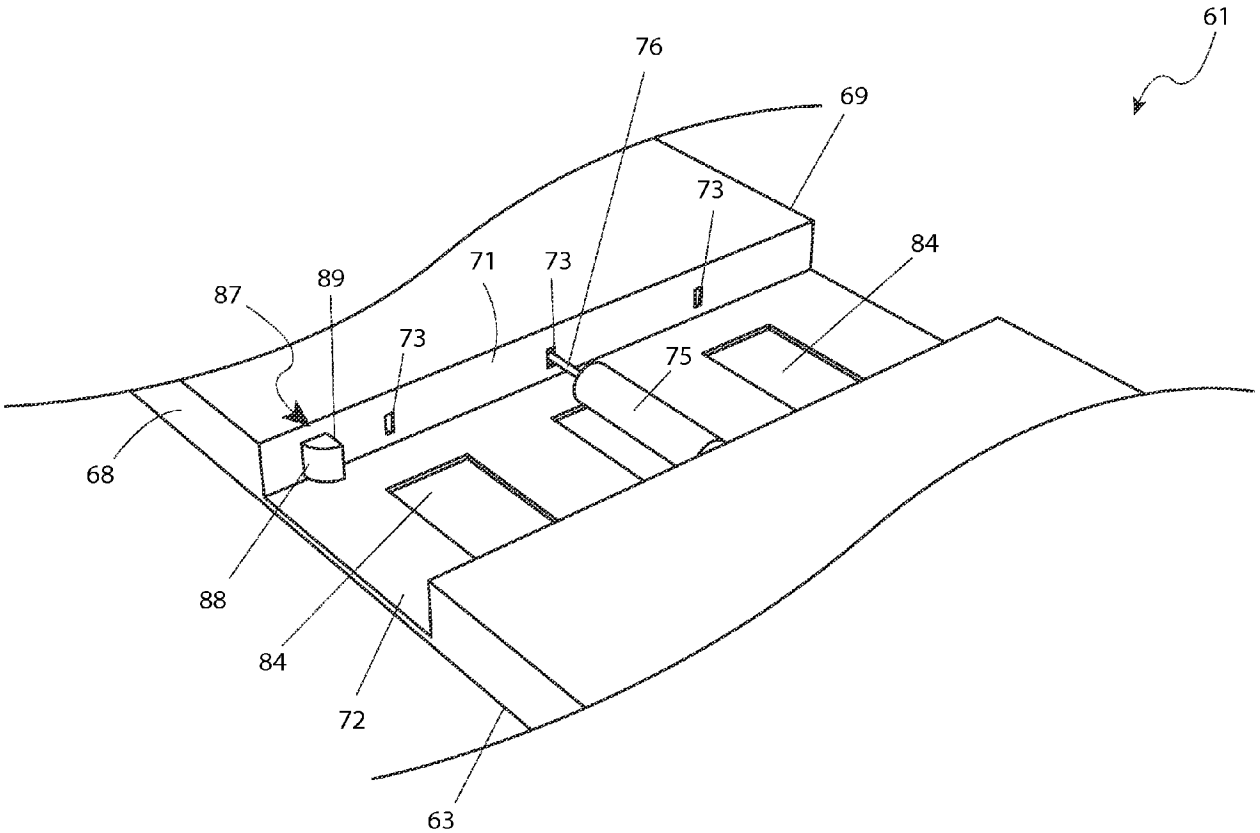
FIG. 12 is a partial perspective view of the alternative plate 61 with the alternative upper surface 62 removed for illustration into a first slide channel 65, of the present invention; and, FIG. 13 is an environmental view of the alternative embodiment 60 showing a person 11 employing the alternative embodiment 60 by advancing the slide bar 79 into the alternative plate 61, of the present invention.

Referring now to FIG. 12, a partial perspective view of the alternative plate 61 with the alternative upper surface 62 removed for illustration into a first slide channel 65, of the of the alternative embodiment 60, is disclosed. FIG. 12 only shows one (1) wheel assembly 74 in place in order to illustrate the configuration of each slide channel 65, 66. Although only the first slide channel 65 is shown, it is understood that the second slide channel 66 is identical to the first slide channel 65. Furthermore, although a single lateral side surface 71 is shown for the first slide channel 65, it is understood that the other lateral side surface 71 is identical. Each fork 81 is further provided with a detent 85 disposed on an outer side 86 surface thereof, which comprises a front end 90 and a back end 91 as shown in FIG. 7. A spring-loaded latch 87 is disposed on a lateral side surface 71 near the first side 68 of each slide channel 65, 66. Each spring-loaded latch 87 is further provided with a beveled edge 88, which faces towards the first side 68, and a flat edge 89, which faces towards the second side 69. The configuration of each spring-loaded latch 87 and detents 85 arrests motion of the slide bar 79 as it is slid from the second side 69 to the first side 68 so as to prevent removal of the side bar 79 from the alternative plate 61. As the slide bar 79 is advanced from the first side 68 to the second side 69, the beveled edge 88 allows the back end 91 to force the latch 87 into the lateral side surface 71, clearing the way for motion of the slide bar 79 along the longitudinal direction 67. As the slide bar 79 is advanced from the second side 69 to the first side 68, the detent 85 permits the latch 87 to protrude from the lateral side surface 71, but as the slide bar 79 advances further, the flat edge 89 abuts the front end 90 arresting the motioning in that direction. The abutment of the front end 90 and the flat edge 89 arrest the motioning in that direction because there are no force vectors to force the latch 87 to move into the lateral side surface 71. If the slide bar 79 is advanced from the first side 68 to the second side 69 again, the abutment of the back end 91 with beveled edge 88 enables generation of force vectors to force the latch 87 into the lateral side surface 71. The spring-loaded latch 87 operates similar to other spring-loaded latch mechanisms and spring-loaded tumbler pins common in the art and disclosed in U.S. Pat. No. 4,856,309 and U.S. Pat. No. 2,699,353; however, other spring-loaded latch 87 mechanisms may be utilized without deviating from the teachings of the system 10.

Figure 13:
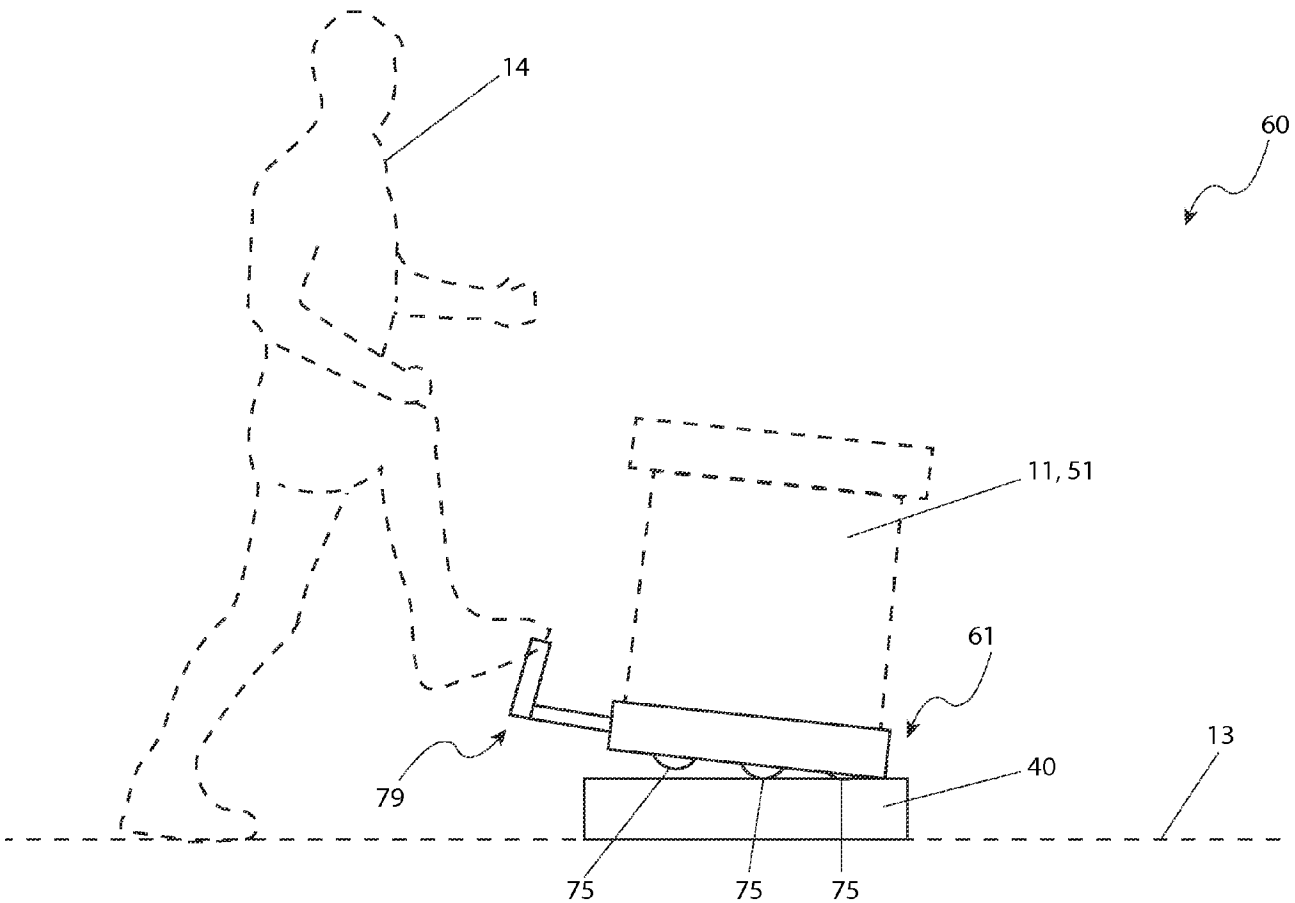

It is envisioned for the slide bar 79 to be advanced from the first side 68 to the second side 69 by grasping the slide bar 79 by the flange 80 with a hand of the user 14 and forcing the slide bar 79 along the longitudinal direction 67. Alternatively, the slide bar 79 may be advanced with the use of a user's foot by kicking or pushing the flange 80, as shown in FIG. 13. Advancing the slide bar 79 from the second side 69 to the first side 68 may be performed by grasping the flange 80 with a user's hand and pulling the slide bar 79 along the longitudinal direction 67.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring the system 10 and an existing trash can 11; fastening the trash can plate 20 onto the trash can bottom surface 12 with the first fastening means 22; securing the ground plate 40 into a ground surface 13 with the stake 30; engaging the trash can plate 20 to the magnet 44 on the ground plate 40 to secure the trash can 11 in position; sliding the trash can plate 20 off of the ground plate 40 to move the trash can 11; utilizing the system 10 as needed; and, utilizing the system 10 to provide a quick and easy way to retain trash cans 11 and prevent damage and toppling in a manner that is quick, easy, and effective.

The alternate embodiment 50 of the present invention can be utilized by the common user in a simple and effortless manner with little or no training. After initial purchase or acquisition of the system 10, it would be installed as indicated in FIG. 6.

The method of installing and utilizing the alternate embodiment 50 may be achieved by performing the following steps: acquiring the alternate embodiment 50; securing the ground plate 40 into a ground surface 13 with the stake 30; engaging the alternate plate 52 to the magnet 44 on the ground plate 40 to secure the alternate trash can 51 in position; sliding the alternate plate 52 off of the ground plate 40 to move the alternate trash can 51; utilizing the alternate embodiment 50 as needed; and, utilizing the alternate embodiment 50 to provide a quick and easy way to retain trash cans 11 and prevent damage and toppling in a manner that is quick, easy, and effective.

The alternative embodiment 60 of the present invention can be utilized by the common user in a simple and effortless manner with little or no training. After initial purchase or acquisition of the system 10, it would be installed as indicated in FIGS. 7 and 13.

The method of installing and utilizing the alternative embodiment 60 may be achieved by performing the following steps: acquiring the alternate embodiment 60; securing the ground plate 40 into a ground surface 13 with the stake 30; fastening the alternative plate 61 to the trash can 11, 51 with the use of the second fastening means 64 or having it be integrally molded thereto; sliding the slide bar 79 to force each wheel assembly 79 into a fully downward direction, thus allowing the trash can 11, 51 and alternative plate 61 to be transported about on the wheel assemblies 74; positioning the trash can 11, 51 over the ground plate 40; sliding the slide bar 79 from the second side 69 to the first side 68 so that each fork 81 disengages each wheel top 82, allowing each wheel assembly 74 to freely traverse the side slot 73 in which it is rotatingly engaged; allowing the magnetic force to pull the alternative plate 61 and ground plate 40 together; utilizing the alternative embodiment 60 to provide a quick and easy way to retain trash cans 11, 51 and prevent damage and toppling in a manner that is quick, easy, and effective; sliding the slide bar 79 from the first side 68 to the second side 69 so that each fork 81 engages a wheel top 82 and forces each wheel assembly 74 into a fully downward direction, whereby providing a lifting force to disengage the plates 61, 40 and support the trash can 11, 51 and alternative plate 61 in an elevated position; and, transporting the trash can 11, 51 on each wheel assembly 74 as desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An anchoring means for anchoring a receptacle, comprising:

a receptacle plate, comprising an upper surface having a mounting means adaptable for receiving and securing said receptacle thereto, a lower surface, a first side, and a second side, comprising:

at least two slide channels disposed within said receptacle plate, wherein said slide channels are arranged in a parallel manner with respect to each other and situated along a longitudinal direction of said receptacle plate;

at least one pair of side slots disposed on lateral side surfaces of each side channel and arranged to diametrically opposing each other; and, at least one wheel opening for each slide channel disposed on said lower surface, wherein an individual wheel opening grants access to a slide channel;

wherein each wheel opening is situated directly beneath a pair of side slots; and, wherein said receptacle plate is a ferrous material;

a wheel assembly for each wheel opening, comprising:

an axle having a pair of distal ends rotatingly engaged with a pair of side slots; and, a wheel rotatingly engaged with each axle and is configured to traverse each wheel opening;

wherein each wheel assembly is configured to freely traverse a length of said pair of side slots;

a slide bar, comprising:

a flange; and, a fork for each slide channel perpendicularly affixed to said flange;

wherein each fork is arranged in a parallel manner to each other;

wherein each fork has a shape complementing a shape of each slide channel so as to enable insertion of an individual fork into an individual slide channel;

wherein said slide bar is configured to slidably engage said slide channels and enable motion of said slide bar in said longitudinal direction; and, wherein said slide bar is configured to engage and disengage each wheel assembly while traversing said longitudinal direction to force each wheel assembly through said wheel opening or to allow each wheel assembly to freely traverse said pair of side slots with which they are engaged;

a ground plate having a bottom end anchored to a ground surface with an anchor, wherein:

said anchor further comprises a cylindrical body with a top head, a tapering end point, and a pair of anchor elements on opposing sides of an intermediate location on said body;

said ground plate further comprises a housing having a corresponding cross-sectional shape matching said receptacle plate;

said ground plate is provided with a magnetic connection means for removably attaching a top end of said ground plate to a bottom surface of said receptacle plate;

said top end is open to reveal said magnetic connection means;

said magnetic connection means is bonded to said ground plate such that said magnet is oriented upwardly;

said magnetic connection means further comprises a magnet aperture aligned with said anchor aperture;

said magnet aperture comprises a larger width than said anchor aperture to permit removal of said anchor; and, said ground plate further comprises a non-ferrous, shielding material for said magnetic connection means;

wherein said anchor is removably receivable within said anchor aperture of said ground plate;

wherein said receptacle is stably and rigidly secured to said ground surface when secured to said receptacle plate, magnetically attached to said ground plate, and said anchor is anchored to said ground surface;

wherein said anchor aperture further comprises a matching geometry for permitting the routing of said anchor in one orientation only, such that said anchor, when oriented in another position, is restricted from travel through said anchor aperture;

wherein when said slide bar is inserted into said slide channels and is slid from said second side to said first side, each fork disengages each wheel assembly allowing each wheel assembly to freely traverse said pair of side slots with which said wheel assembly is rotatingly engaged; and, wherein when said slide bar is inserted into said slide channels and is slid from said first side to said second side, each fork engages each wheel assembly and forces each wheel assembly to extend through each wheel opening and protrude through said lower surface.

2. The anchoring means of claim 1, wherein a distal end of each fork is beveled to facilitate smooth engagement and disengagement with each wheel assembly.

3. The anchoring means of claim 1, further comprising:

a spring-loaded latch disposed on each lateral side surface and proximally to said first side of each slide channel, said spring-loaded latch provides a beveled edge facing said first side and a flat edge facing said second side; and, a detent disposed on a side surface of each fork located proximally near a distal end of said fork;

wherein said spring-loaded latch is configured to arrest traverse motion of said slide bar from said second side to said first side when said spring-loaded latch engages said detents; and, wherein said spring-loaded latch is configured to permit free traverse motion of said slide bar from said first side to said second side.

4. The anchoring means of claim 1, wherein said mounting means is a plurality of adhesive strips.

5. The anchoring means of claim 1, wherein each wheel is a non-ferrous material.

6. The anchoring means of claim 1, wherein said slide bar is a non-ferrous material.

7. An anchoring means for anchoring a receptacle, comprising:

said receptacle, comprising a bottom wall, a side wall, an open top, a lid removably attached to said open top, and a receptacle plate located at a bottom surface of said bottom wall;

said receptacle plate having an upper surface integrally molded to said receptacle bottom surface, a lower surface, a first side, and a second side, comprising:

at least two slide channels disposed within said receptacle plate, wherein said slide channels are arranged in a parallel manner with respect to each other and situated along a longitudinal direction of said receptacle plate;

at least one pair of side slots disposed on lateral side surfaces of each side channel and arranged to diametrically opposing each other; and, at least one wheel opening for each slide channel disposed on said lower surface, wherein an individual wheel opening grants access to a slide channel;

wherein each wheel opening is situated directly beneath a pair of side slots; and, wherein said receptacle plate is a ferrous material;

a wheel assembly for each wheel opening, comprising:

an axle having a pair of distal ends rotatingly engaged with a pair of side slots; and, a wheel rotatingly engaged with each axle and configured to traverse each wheel opening;

wherein each wheel assembly is configured to freely traverse a length of said pair of side slots;

a slide bar, comprising:

a flange; and, a fork for each slide channel perpendicularly affixed to said flange;

wherein each fork is arranged in a parallel manner to each other;

wherein each fork has a shape complementing a shape of each slide channel so as to enable insertion of an individual fork into an individual slide channel;

wherein said slide bar is configured to slidably engage said slide channels and enable motion of said slide bar in said longitudinal direction; and, wherein said slide bar is configured to engage and disengage each wheel assembly while traversing said longitudinal direction to force each wheel assembly through said wheel opening or to allow each wheel assembly to freely traverse said pair of side slots with which they are engaged;

a ground plate having a bottom end anchored to a ground surface with an anchor, wherein:

said anchor further comprises a cylindrical body with a top head, a tapering end point, and a pair of anchor elements on opposing sides of an intermediate location on said body;

said ground plate further comprises a housing having a corresponding cross-sectional shape matching said receptacle plate;

said ground plate is provided with a magnetic connection means for removably attaching a top end of said ground plate to a bottom surface of said receptacle plate;

said top end is open to reveal said magnetic connection means;

said magnetic connection means is bonded to said ground plate such that said magnet is oriented upwardly;

said magnetic connection means further comprises a magnet aperture aligned with said anchor aperture;

said magnet aperture comprises a larger width than said anchor aperture to permit removal of said anchor; and, said ground plate further comprises a non-ferrous, shielding material for said magnetic connection means;

wherein said anchor is removably receivable within said anchor aperture of said ground plate;

wherein said receptacle is stably and rigidly secured to said ground surface when said receptacle plate is magnetically attached to said ground plate and said anchor is anchored to said ground surface;

wherein said anchor aperture further comprises a matching geometry for permitting the routing of said anchor in one orientation only, such that said anchor, when oriented in another position, is restricted from travel through said anchor aperture;

wherein when said slide bar is inserted into said slide channels and is slid from said second side to said first side, each fork disengages each wheel assembly allowing each wheel assembly to freely traverse said pair of side slots with which said wheel assembly is rotatingly engaged; and, wherein when said slide bar is inserted into said slide channels and is slid from said first side to said second side, each fork engages each wheel assembly and forces each wheel assembly to extend through each wheel opening and protrude through said lower surface.

8. The anchoring means of claim 7, wherein a distal end of each fork is beveled to facilitate smooth engagement and disengagement with each wheel assembly.

9. The anchoring means of claim 7, further comprising:

a spring-loaded latch disposed on each lateral side surface and proximally to said first side of each slide channel, said spring-loaded latch provides a beveled edge facing said first side and a flat edge facing said second side; and, a detent disposed on a side surface of each fork located proximally near a distal end of said fork;

wherein said spring-loaded latch is configured to arrest traverse motion of said slide bar from said second side to said first side when said spring-loaded latch engages said detents; and, wherein said spring-loaded latch is configured to permit free traverse motion of said slide bar from said first side to said second side.

10. The anchoring means of claim 7, wherein said mounting means is a plurality of adhesive strips.

11. The anchoring means of claim 7, wherein each wheel is a non-ferrous material.

12. The anchoring means of claim 7, wherein said slide bar is a non-ferrous material.

* * * * *